US010611520B2

(12) United States Patent
Sussman

(10) Patent No.: US 10,611,520 B2
(45) Date of Patent: Apr. 7, 2020

(54) TOTE RETAINER DEVICE

(71) Applicant: Locus Robotics Corp., Wilmington, MA (US)

(72) Inventor: Peter Sussman, Winchester, MA (US)

( * ) Notice: Subject to any disclaimer, the term of this patent is extended or adjusted under 35 U.S.C. 154(b) by 42 days.

(21) Appl. No.: 15/888,769

(22) Filed: Feb. 5, 2018

(65) Prior Publication Data

US 2019/0241313 A1 Aug. 8, 2019

(51) Int. Cl.
*B65D 21/02* (2006.01)

(52) U.S. Cl.
CPC ..... *B65D 21/0224* (2013.01)

(58) Field of Classification Search
CPC ..... B65D 21/0224; B65D 21/0209; B65D 21/02; B65D 21/00
See application file for complete search history.

(56) References Cited

U.S. PATENT DOCUMENTS 2,135,401 A * 11/1938 Kiff ..... B65D 21/0224 206/503
4,239,306 A * 12/1980 Klaus ..... A47B 47/06 211/194
5,454,634 A 10/1995 Herbst et al.
5,593,037 A 1/1997 Ohayon
6,592,025 B2 7/2003 Bazany et al.
8,960,469 B1 2/2015 Helal et al.
9,014,844 B2 4/2015 Casey et al.
9,463,927 B1 10/2016 Theobald
2002/0114720 A1 8/2002 Itoh et al.
2010/0296908 A1 11/2010 Ko
2011/0200420 A1 8/2011 Driskill et al.
2012/0330458 A1 12/2012 Weiss
2013/0317642 A1 11/2013 Asaria et al.
2014/0251998 A1* 9/2014 Kinskey ..... B65D 45/18 220/324

OTHER PUBLICATIONS

Husky Stackable 9 in. Click Bin, Gray (4-Pack)—17193661—The Home Depot [online]. [retrieved Feb. 6, 2018] Retrieved from the Internet: <URL:https://www.homedepot.com/p/Husky-Stackable-9-in-Click-Bin-Gray-4-Pack-17193661/202931355>.

* cited by examiner

*Primary Examiner* — Andrew T Kirsch
*Assistant Examiner* — Don M Anderson
(74) *Attorney, Agent, or Firm* — John W. Powell; Verrill

(57) ABSTRACT

A retainer device for removably connecting a first tote to a second tote in a stacked arrangement includes an elongated body member including a top surface, a bottom surface, and a channel disposed in the bottom surface and extending along a length of the elongated body member. There is a leg member affixed to the elongated body member at a first angle with respect to the top surface of the elongated body member and extending at least partially along the length of the elongated body member. There is also at least one foot member having a top surface; the at least one foot member affixed to the leg member at a second angle such that the top surface of at least one foot member faces the bottom surface of the elongated body member to define a region for receiving portions of the first and second totes.

11 Claims, 9 Drawing Sheets

TOTE RETAINER DEVICE

FIELD OF INVENTION

This invention relates to a retainer device for securing multiple totes in a tote storage array which may be used, for example, for product order-fulfillment systems and more particularly to such a retainer device which is removable to enable reuse and reconfiguration of the totes in the tote storage arrays.

BACKGROUND

Ordering products over the internet for home delivery is an extremely popular way of shopping. Fulfilling such orders in a timely, accurate and efficient manner is logistically challenging to say the least. Clicking the "check out" button in a virtual shopping cart creates an "order." The order includes a listing of items that are to be shipped to a particular address. The process of "fulfillment" involves physically taking or "picking" these items from a large warehouse, packing them, and shipping them to the designated address. An important goal of the order-fulfillment process is thus to ship as many items in as short a time as possible.

Among the tasks of order fulfillment is therefore that of traversing the warehouse to find and collect the various items listed in a customer order. Certain order-fulfillment processes use only human operators to pick and place goods. Often the human operators use carts to assist them in transporting the goods around the warehouse. In other cases, robots are used to increase efficiency and productivity. In both cart-based and robot-based systems, totes or containers may be used to organize the goods being transported. And, in certain cases, a plurality of individual totes or containers may be interconnected to form a tote array to organize the goods for multiple orders.

To ensure they are lightweight while being sufficiently durable, the totes may be formed of a rigid polyofelin plastic material, such as polyethylene. In order to adequately secure each tote to an adjacent tote, a relatively strong adhesive, such as LocTite 3035, has been used. However, separating totes that have been adhered using glue often results in the hard plastic material of the totes breaking. Therefore, it has been found that separating the individual totes from the tote arrays for reuse/reconfiguration is generally not possible. This is a less than desirable result and a secure, convenient, and easy way to interconnect totes which may be later disconnected (for reuse/reconfiguration) without destroying or damaging the totes is needed.

SUMMARY

An object of the invention is to provide a tote retainer device, which enables a secure, convenient, and easy way to interconnect multiple totes.

Another object of the invention is to provide such a tote retainer device which also enables the totes to be disconnected without destroying or damaging the totes so that they may be reused and/or reconfigured.

In one aspect the invention features a retainer device for removably connecting a first tote to a second tote in a stacked arrangement, the first tote including a rail disposed along a top edge of the first tote and a lip disposed adjacent to the rail, the second tote including a flange disposed along a bottom edge of the second tote, the flange of the second tote being seated on the rail of the first tote when the second tote is stacked on the first tote. The retainer device includes an elongated body member including a top surface, a bottom surface, and a channel disposed in the bottom surface and extending along a length of the elongated body member. There is a leg member affixed to the elongated body member at a first angle with respect to the top surface of the elongated body member and extending at least partially along the length of the elongated body member. There is also at least one foot member having a top surface and the at least one foot member is affixed to the leg member at a second angle such that the top surface of at least one foot member faces the bottom surface of the elongated body member to define a region there between. The channel is configured to receive and engage with the lip of the first tote and the region defined between the top surface of at least one foot member and the bottom surface of the elongated body member is configured to receive and engage with the rail of the first tote and the flange of the second tote when the second tote is stacked on the first tote.

In other aspects of the invention, one or more of the following features may be included. The first and second angles may be approximately 90 degrees. The elongated body member, the leg member, and the at least one foot member may be integrally formed. The leg member may extend along the entire length of the elongated body member 5. The at least one foot member may include a first foot member located proximate a first end of the elongated body member and a second foot member located proximate a second end of the elongated body member, and each foot member has a top surface which faces the bottom surface of the elongated body member to define the region. The top surface of the elongated body member may include two holes which extend at an angle through the bottom surface, one hole being aligned with the first foot member and the other hole being aligned with the second foot member. The rail of the first tote and the flange of the second tote when the second tote is stacked on the first tote may be positioned in the region, the holes may be configured to receive screws which are inserted through the rail of the first tote and the flange of the second tote and into the respective top surface of the first and second foot members to secure the retainer device to the first and second totes. The angle of the two holes may be approximately 75 degrees with respect to the top surface of the elongated body member. The bottom surface of the elongated body member may be disposed at an angle relative to the top surface of the elongated body member and the angle may be complementary to an angle of a top surface of the flange of the second tote. The bottom surface of the elongated body member may be disposed at an angle of approximately 30 degrees. The channel may be disposed between the bottom surface of the elongated body member and the leg member.

These and other features of the invention will be apparent from the following detailed description and the accompanying figures, in which:

DETAILED DESCRIPTION

Figure 1:
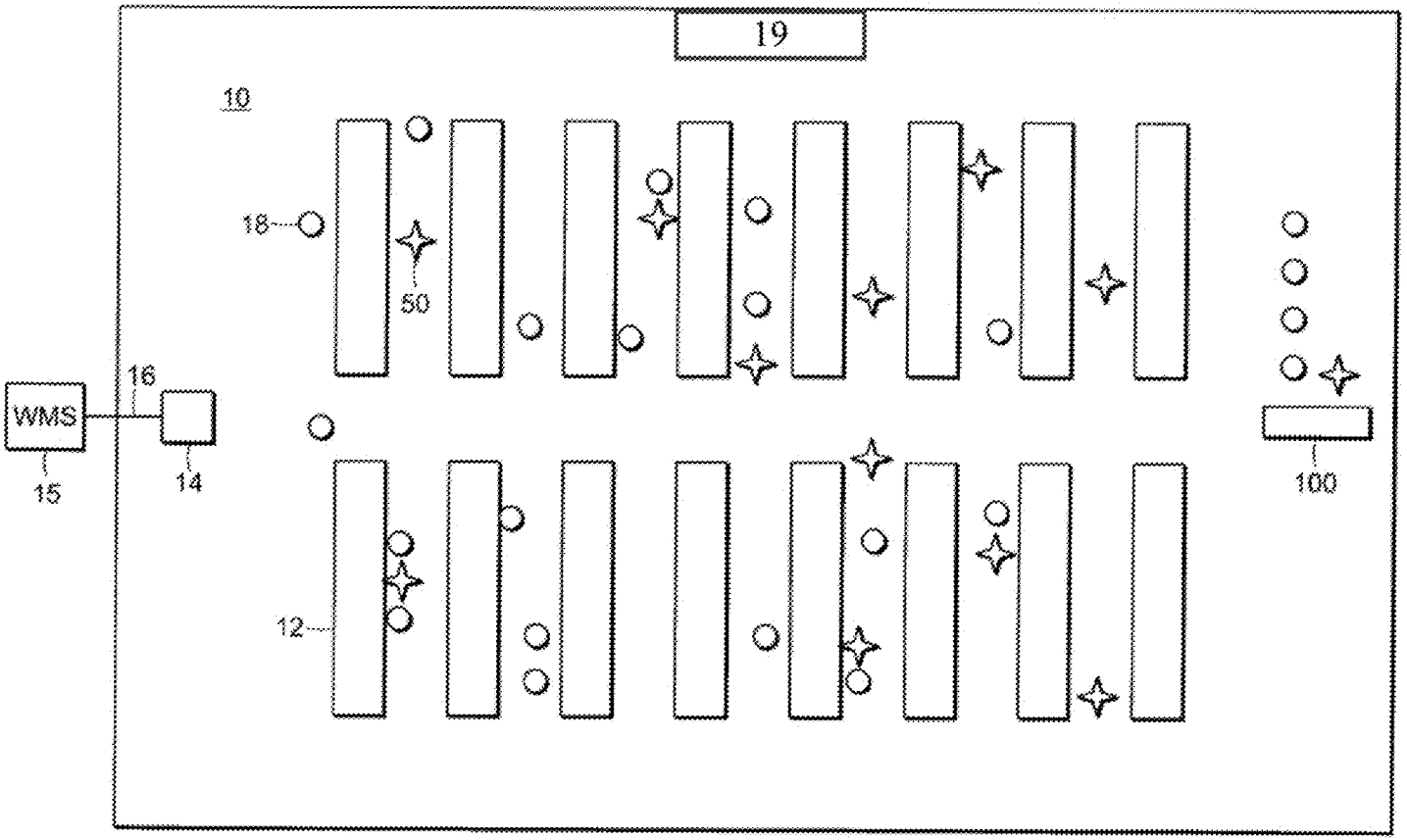
FIG. 1 is a top plan view of an order-fulfillment warehouse.

The invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The invention is directed to a tote retainer device for use in tote storage arrays. Although not restricted to any particular application, one suitable application that the invention may be used in is order fulfillment with or without the use of autonomous mobile robots. An application using robots to transport tote storage arrays will be described first, but only to provide context for the invention. Then, the tote retainer device according to the invention will be described in connection with a tote storage array. The robot system described herein used to transport the tote storage array is not limiting in any way to the tote retainer device, and such tote retainer device may be used in any application using a tote storage array.

Referring to FIG. 1, a typical order-fulfillment warehouse 10 includes shelves 12 filled with the various items that could be included in an order 16. In operation, the order 16 from warehouse management server 15 arrives at an order-server 14. The order-server 14 communicates the order 16 to a robot 18 selected from a plurality of robots that traverse the warehouse 10. Also shown is charging area 19, which is where one or more charging stations according to an aspect of the invention may be located.

Figure 2A:
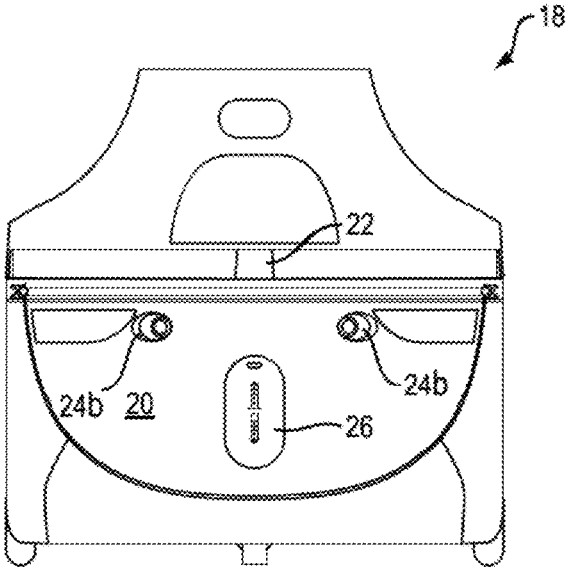
FIG. 2A is a front elevational view of a base of one of the robots used in the warehouse shown in FIG. 1.
Figure 2B:
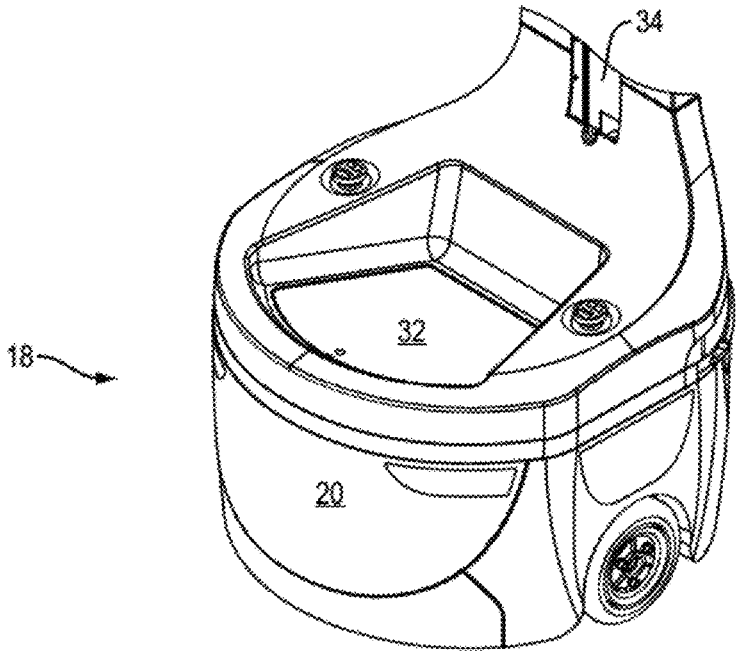
FIG. 2B is a perspective view of a base of one of the robots used in the warehouse shown in FIG. 1.
Figure 3:
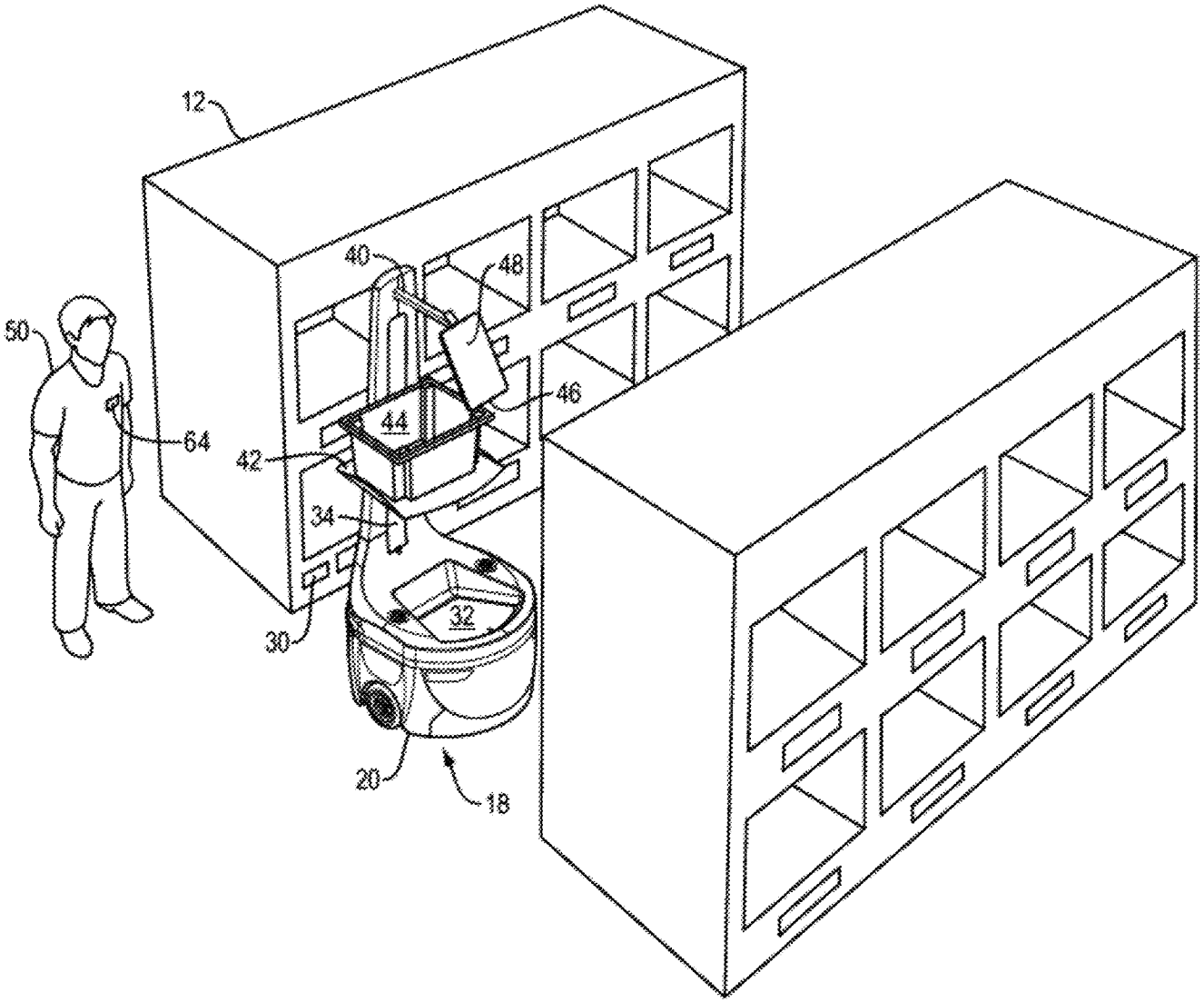
FIG. 3 is a perspective view of the robot in FIG. 2 outfitted with an armature and parked in front of a shelf shown in FIG. 1.

In a preferred embodiment, a robot 18, shown in FIGS. 2A and 2B, includes an autonomous wheeled base 20 having a laser-radar 22. The base 20 also features a transceiver (not shown) that enables the robot 18 to receive instructions from the order-server 14, and a pair of digital optical cameras 24*a* and 24*b*. The robot base also includes an electrical charging port 26 for re-charging the batteries which power autonomous wheeled base 20. The base 20 further features a processor (not shown) that receives data from the laser-radar and cameras 24*a* and 24*b* to capture information representative of the robot's environment. There is a memory (not shown) that operates with the processor to carry out various tasks associated with navigation within the warehouse 10, as well as to navigate, for example, to fiducial marker 30 placed on shelves 12, as shown in FIG. 3. Fiducial marker 30 (e.g. a two-dimensional bar code) corresponds to bin/location of an item ordered.

Referring again to FIG. 2B, base 20 includes an upper surface 32 where a tote could be stored to carry items. There is also shown a coupling 34 that engages any one of a plurality of interchangeable armatures 40, one of which is shown in FIG. 3. The particular armature 40 in FIG. 3 features a tote-holder 42 (in this case a shelf) for carrying a tote 44 that receives items, and a tablet holder 46 (or laptop/other user input device) for supporting a tablet 48. In some embodiments, the armature 40 supports one or more totes for carrying items. In other embodiments, the base 20 supports one or more totes for carrying received items. As used herein, the term "tote" includes, without limitation, cargo holders, bins, cages, shelves, rods from which items can be hung, caddies, crates, racks, stands, trestle, containers, boxes, canisters, vessels, and repositories. These terms may be used interchangeably throughout this application.

In this application, a local operator 50, which is typically human, carries out the task of physically removing an ordered item from a shelf 12 and placing it on robot 18, for example, in tote 44. The robot 18 communicates the order to the local operator 50 via the tablet 48 (or laptop/other user input device), which the local operator 50 can read, or by transmitting the order to a handheld device used by the local operator 50.

Upon receiving an order 16 from the order server 14, the robot 18 proceeds to a first warehouse location, e.g. as shown in FIG. 3. It does so based on navigation software stored in the memory and carried out by the processor. The navigation software relies on data concerning the environment, as collected by the laser-radar 22, an internal table in memory that identifies the fiducial identification ("ID") of fiducial marker 30 that corresponds to a location in the warehouse 10 where a particular item can be found, and the cameras 24*a* and 24*b* to navigate. A preferred navigation approach is described in co-pending U.S. patent application Ser. No. 15/712,222, entitled Multi-Resolution Scan Matching with Exclusion Zones, filed on Sep. 22, 2017.

Upon reaching the correct location, the robot 18 parks itself in front of a shelf 12 on which the item is stored and waits for a local operator 50 to retrieve the item from the shelf 12 and place it in tote 44. If robot 18 has other items to retrieve it proceeds to those locations. The item(s) retrieved by robot 18 are then delivered to a packing station 100, FIG. 1, where they are packed and shipped.

It will be understood by those skilled in the art that each robot may be fulfilling one or more orders and each order may consist of one or more items. Instead of using a single tote, a storage or tote array having two or more totes or containers which are affixed to one another, may be used. Each of the totes/containers or compartments may be associated with a separate order or multiple totes/containers/compartments may be used for and associated with a single, larger order.

Figure 4:
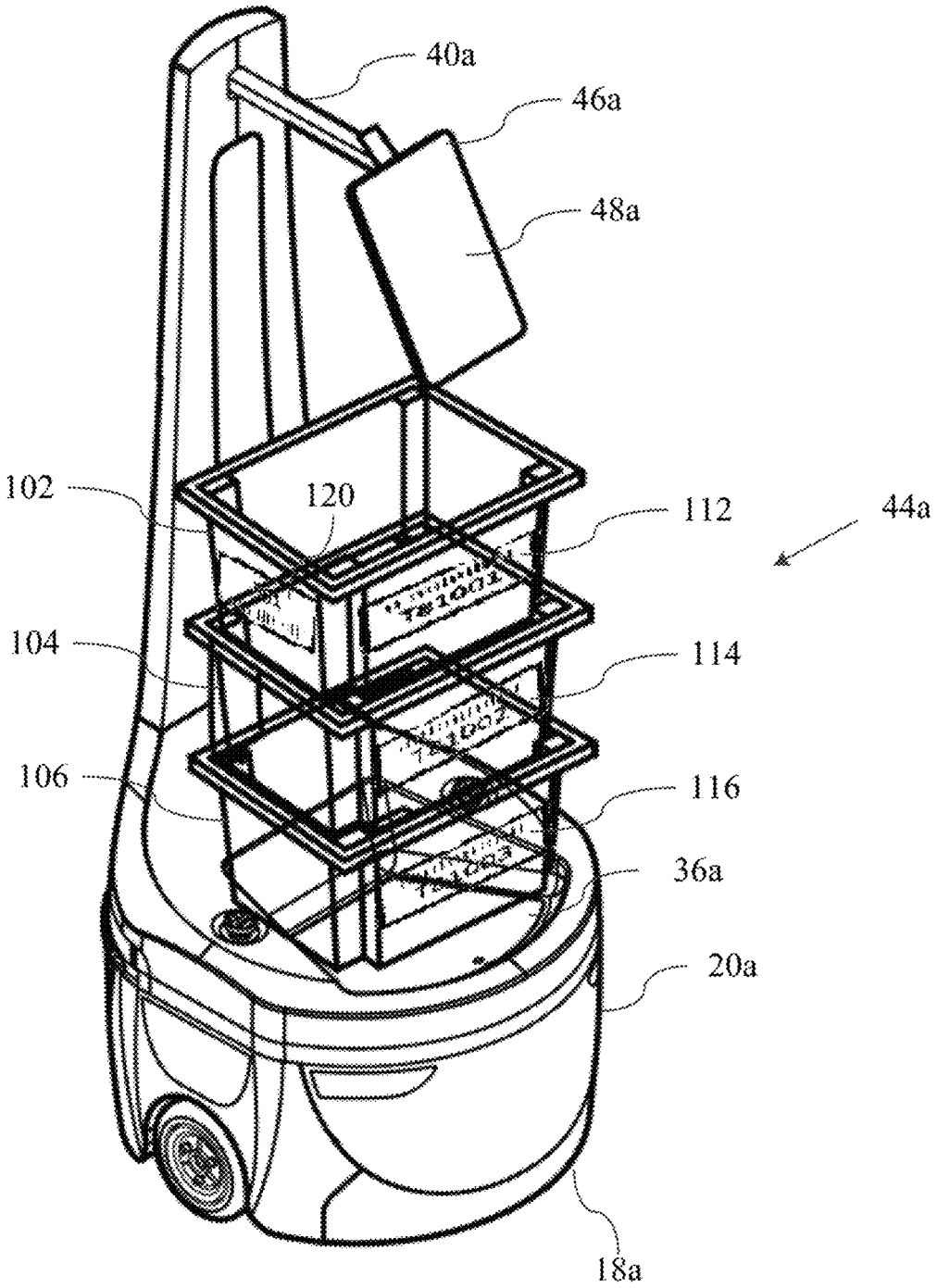
FIG. 4 is a perspective view of the robot in FIG. 3 outfitted with an armature and a storage array according to the invention.

One embodiment of the storage array according to this invention is described with regard to FIG. 4. Robot 18*a* is shown to include an upper surface 36*a* of a wheeled base 20*a*. There is an armature 40*a* which at a first end is connected to wheeled base 20*a* (connection not visible in this view) and at its other end it connects to tablet holder 46*a* for supporting a tablet 48*a*. Unlike armature 40, FIG. 3, armature 40*a* does not include a tote-holder 42 for carrying a tote 44 that receives items. Instead, the storage array 44*a* is placed on upper surface 36*a* of wheeled base 20*a*.

In this embodiment, storage array 44*a* includes three storage containers 102, 104, and 106, which are vertically stacked upon each other and are fixedly interconnected to form an integrated array. Each container 102, 104, and 106 in storage array 44*a* includes a bar code disposed on bar code labels 112, 114, and 116, respectively. Also on each bar code label is a number associated with each container, which may be read by a human operator, such as operator 50*a*, FIG. 5, to identify the different containers. The numbers in this example are "T81001", "T81002", and "T81003" associated with containers 102, 104, and 106, respectively. In order to make it easier to distinguish among the contains, they may be colored differently. For example, container 102, may be colored blue in whole or in part. Container 104, may be colored yellow in whole or in part and container 106, may be colored green in whole or in part.

In addition, there is included a bar code label 120, which is associated with the storage array 44*a*. The bar code label 120 also includes a storage array identification number, in this case "001", for the operator 50*a* to identify it among the various storage arrays. Bar code label 120 is positioned on a side of container 102, but this label could be positioned in various locations on the storage array.

An operator may initiate a "pick" process with a robot by inducting it into the system and providing notification to warehouse management system ("WMS") 15 that robot 18*a* is available to receive and execute an order. In the induction process, the operator may interact with the robot 18*a* via a touch screen on the tablet 48*a* of the robot or via a handheld wireless device to activate it. The robot then communicates to WMS 15 that it is ready to receive its order session. The operator also provides robot 18*a* with a storage array, such as storage array 44*a*.

Rather than inducting each container 102, 104, and 106 individually and obtaining an order for each serially by scanning the bar code labels 112, 114, and 116 for each container, the operator may scan only bar code label 120, associated with storage array 44*a*, in order to efficiently generate the orders for all three individual containers. This process is described more fully in co-pending U.S. patent application Ser. No. 15/254,321, entitled Item Storage Array for Mobile Base in Robot Assisted Order-Fulfillment Operations, filed on Sep. 1, 2016.

Figure 5:
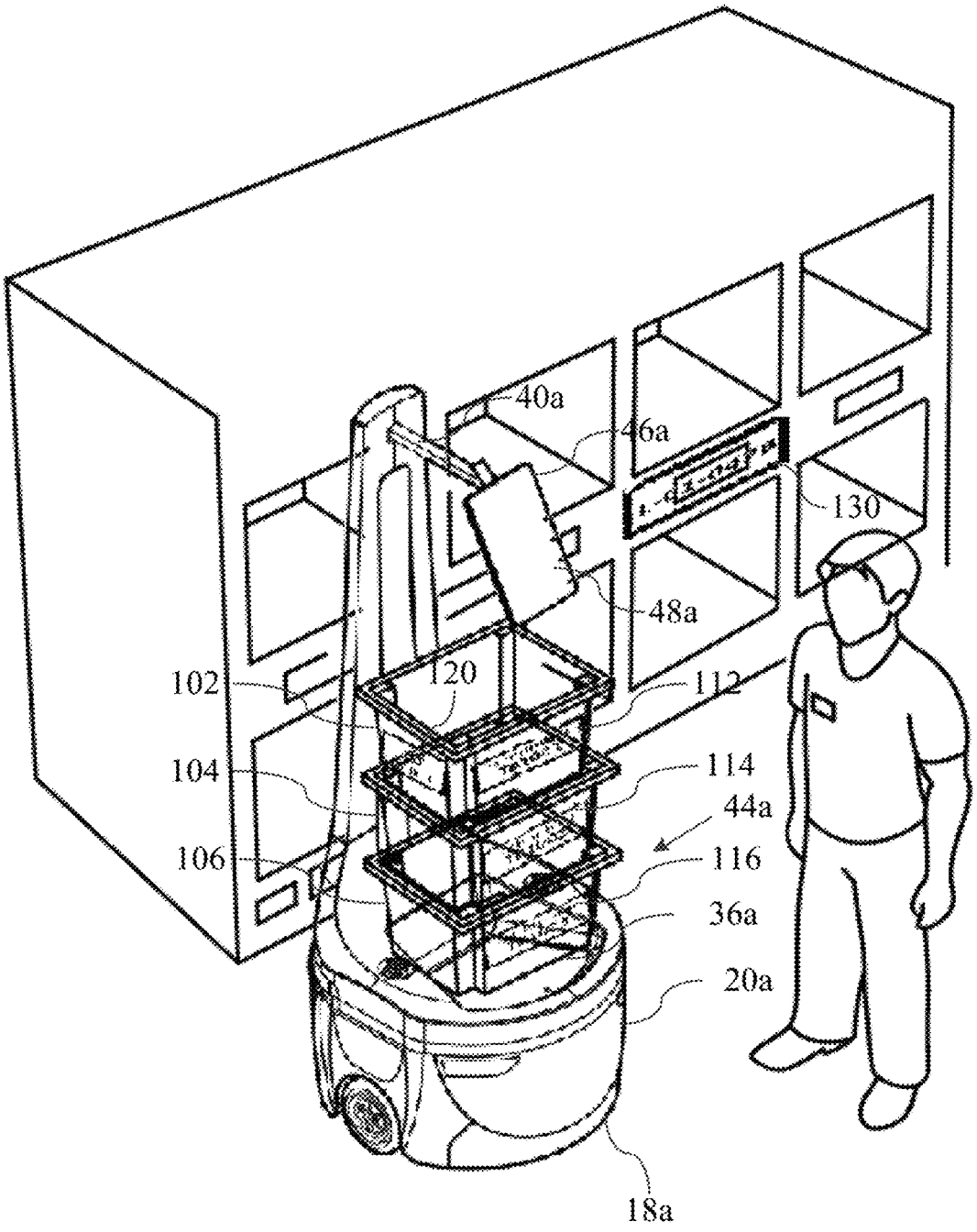
FIG. 5 is a perspective view of the robot and storage array of FIG. 4 parked in front of a shelf.

In the approach for securing multiple totes together to form a tote array, as depicted in FIGS. 4 and 5, the individual totes/storage containers 102, 104, and 106, are vertically stacked upon each other and are fixedly interconnected using an adhesive. To ensure they are lightweight while being sufficiently durable, containers 102, 104, and 106 may be formed of a rigid polyofelin plastic material, such as polyethylene. In order to adequately secure each tote to an adjacent tote, a relatively strong adhesive, such as LocTite 3035, has been used. However, separating totes that have been adhered using glue often results in the hard plastic material of the totes breaking. Therefore, it has been found that separating the individual totes from the tote arrays for reuse/reconfiguration is generally not possible. This is a less than desirable result and a secure, convenient, and easy way to interconnect totes, which may be disconnected without destroying or damaging the totes is needed.

Figure 6:
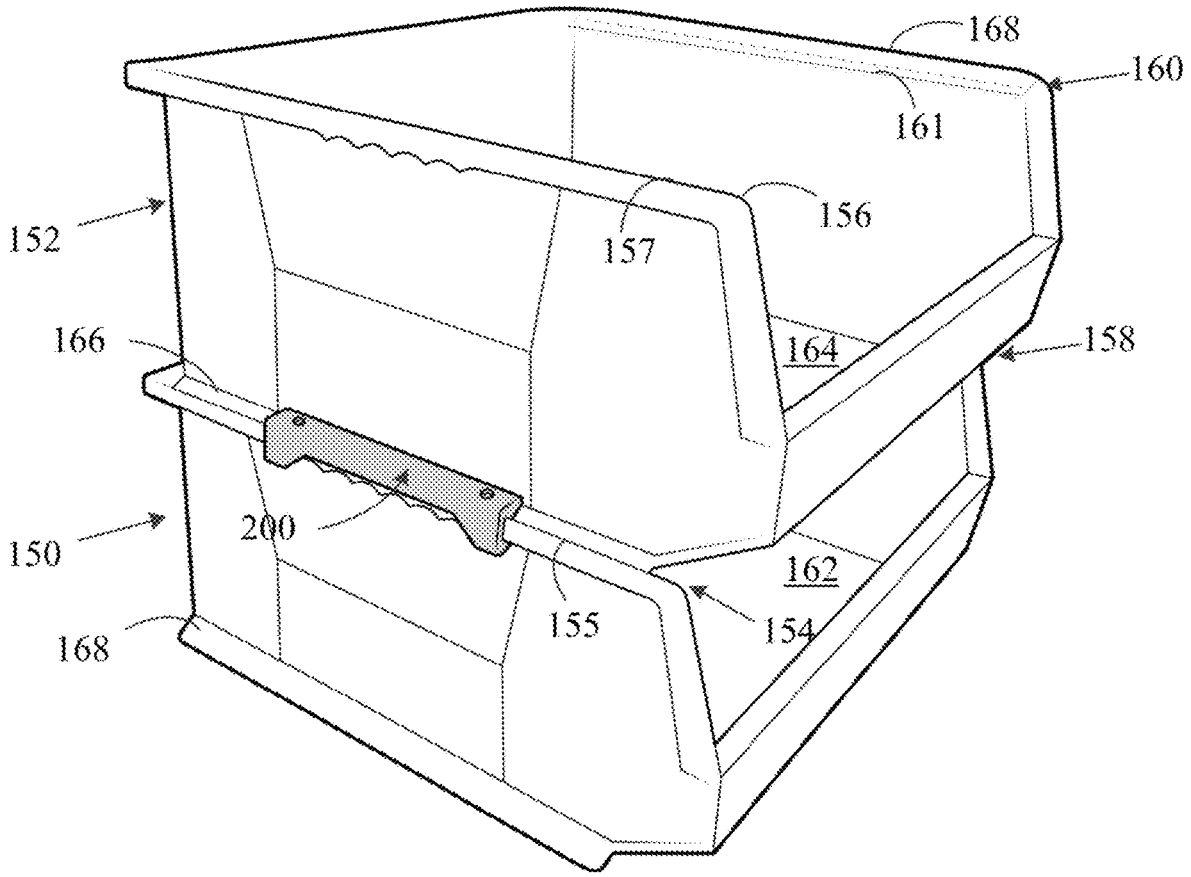
FIG. 6 is a perspective view of a two tote stack interconnected with a retainer device according to an aspect of this invention.

A tote retainer device 200, according to an aspect of this invention, which interconnects one tote to another tote and which may be easily removed to allow the totes to be disconnected is depicted in FIG. 6 connecting two totes 150 and 152 in a stacked arrangement. Although not visible in this figure, another tote retainer device 200 will be secured to the opposite side of the totes 150 and 152 to adequately sure the two totes together. Totes 150 and 152, respectively, include left side top edges 154 and 156 and right side top edges 158 and 160. Each top edge is comprised of a rail running from the front of the tote to the rear of the tote and having a flat surface parallel to the bottom surface of the tote. For example, the bottom surface of tote 150 is surface 162 which would be parallel to the rails of top edges 154 and 158 and the bottom surface of tote 152 is surface 164 which would be parallel to the rails of top edges 156 and 160. In this view only rail 161 of right side top edge 160 is visible.

Each rail is configured to receive a bottom surface of a bottom edge flange on the tote above it in a stacked arrangement. For example, tote 152 includes a bottom edge flange 166 which runs along its bottom left edge from the front of the tote to the rear of the tote. Bottom edge flange has a bottom surface (not visible) which is seated flush on the rail of top edge 154 of tote 150. Tote 150 includes a bottom edge flange 168 which runs along its bottom left edge from the front of the tote to the rear of the tote. This bottom edge flange also has a bottom surface (not visible) which may be seated on a surface of a robot or on the rail of another tote in the tote array.

Each top edge also includes a lip which extends from its rail in a direction substantially perpendicular to the rail. Thus, tote 150 includes lip 155 which runs along its top left edge 154 from the front of tote 150 to the rear of tote 150 and extends in a direction substantially perpendicular to the rail (not visible) of edge 154. The top right edge 158 of tote 150 includes a rail and a lip but they are not visible in this figure. Tote 152 includes lip 157 which runs along its top left edge 156 from the front of tote 152 to the rear of tote 152 and extends in a direction substantially perpendicular to the rail (not visible) of edge 156. The top right edge 160 of tote 156 includes a rail 161 a lip 163, which in this view can be seen to extend from rail 161 in a substantially perpendicular direction.

Figure 7B:
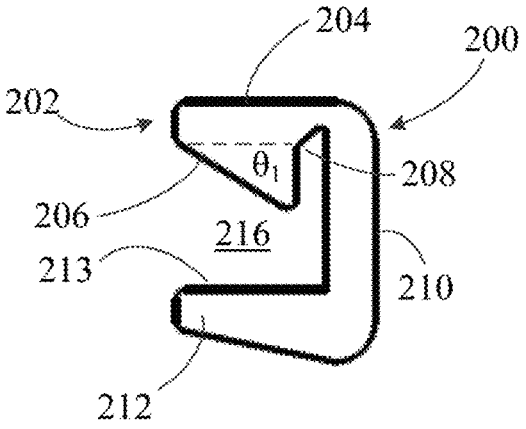
FIG. 7B is a cross-sectional view of the retainer device of FIG. 7A.
Figure 7A:
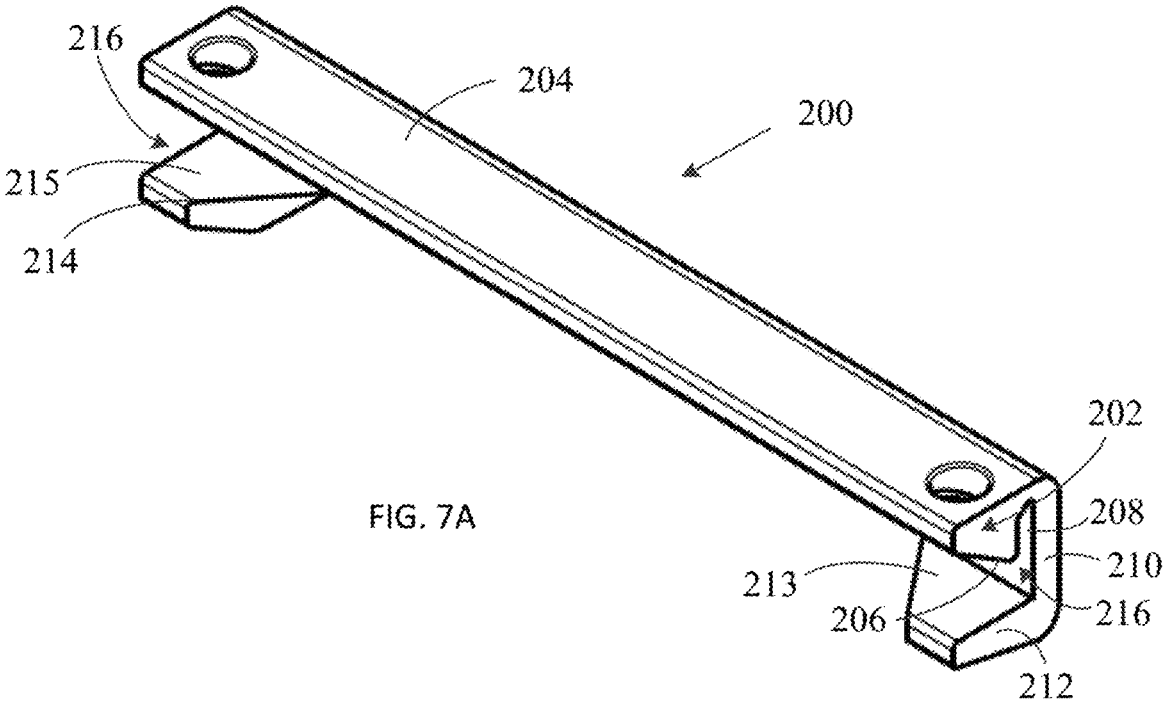
FIG. 7A is a perspective view of the retainer device of FIG. 6.
Figure 9:
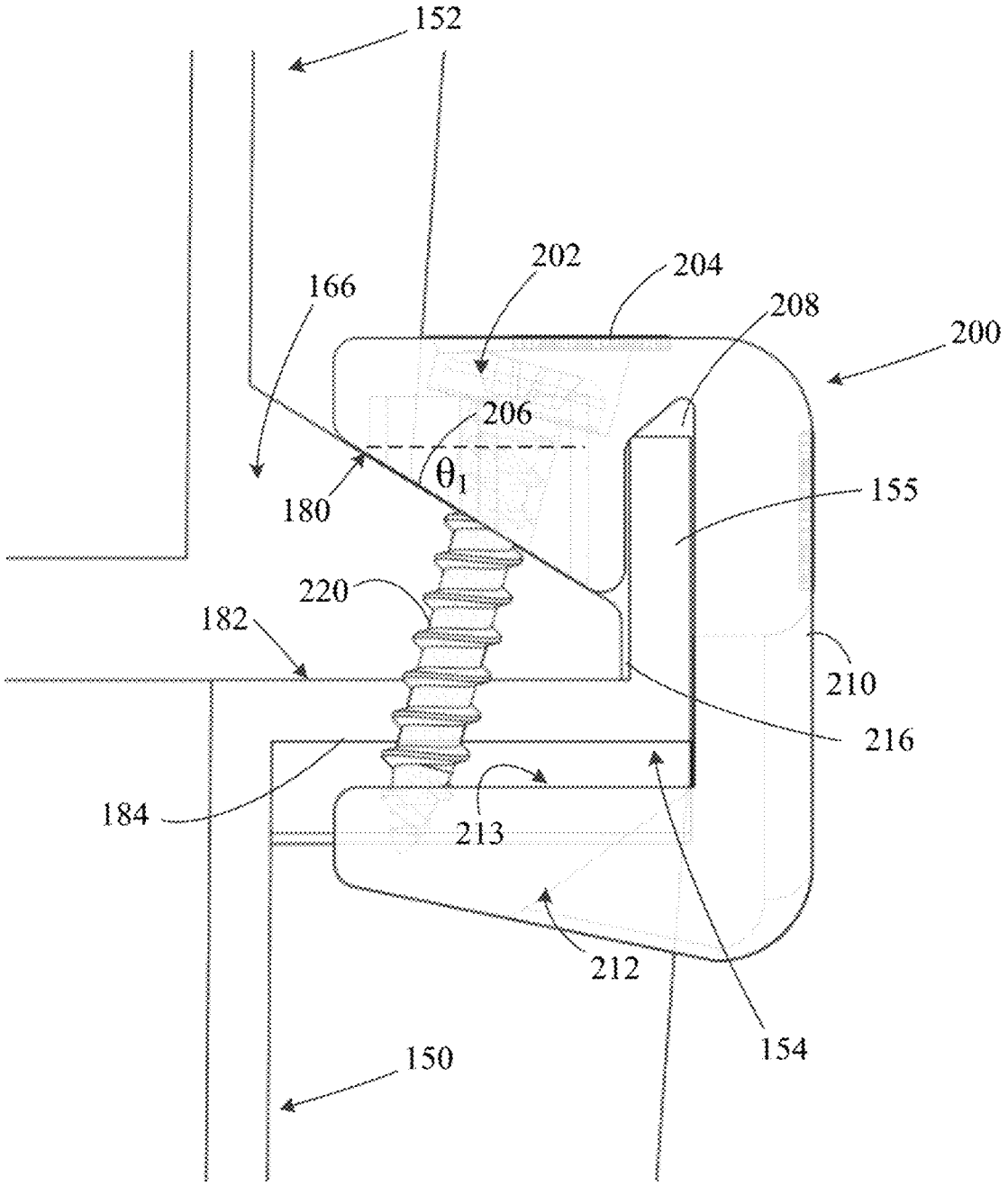
FIG. 9 is a cross-sectional view of the retainer device of FIG. 6 interconnecting the stacked two tote configuration.

Before describing in more detail how tote retainer device 200 is installed on and interconnects totes 150 and 152 with regard to FIG. 9, tote retaining device is described. Referring to FIGS. 7A and 7B, tote retainer device 200 is shown to include an elongated body member 202 having a top surface 204, a bottom surface 206, and a channel 208. Bottom surface of elongated body member 202 is disposed at an angle, $\Theta_1$, relative to top surface 204. Disposing bottom surface 206 at an angle, $\Theta_1$, allows for the retainer device 200 to be more easily installed on the totes by allowing for easier insertion and engagement, as will be described below. In the embodiment shown angle, $\Theta_1$, is approximately 30 degrees but this angle may be varied depending on the particular application.

Disposed or formed in bottom surface 206 is channel 208. Channel 208 extends along the length of the elongated body member 202. There is a leg member 210 affixed to the elongated body member 202 at an angle with respect to the top surface 204 of the elongated body member 202 and extending along the length of the elongated body member 202. The leg member 210 may be integrally formed with elongated body member 202 and may be disposed at substantially a right angle. It should be noted that leg member 210 extends along the full length of elongated body member 202, but it does not need to be and (although not shown) it could extend only partially along the length in a continuous manner or it could be segmented in order to reduce the amount of material used to fabricate the tote retainer device 200.

Continuing to refer to FIGS. 7A and 7B, there is at least one foot member, and in this embodiment there are two foot members, 212 and 214, which are disposed at opposite ends of elongated body member 202. Foot members 212 and 214 may be integrally formed with leg member 210, and they may be disposed substantially at right angles to leg member 210. Foot members 212 and 214 have top surfaces 213 and 215, respectively, which are also oriented at substantially right angles to leg member 210 and are directed toward/facing bottom surface 206 of elongated body member 202, together defining a region 216. As described below, region 216 is where the portions of the two totes to be interconnected are received.

Figure 8B:
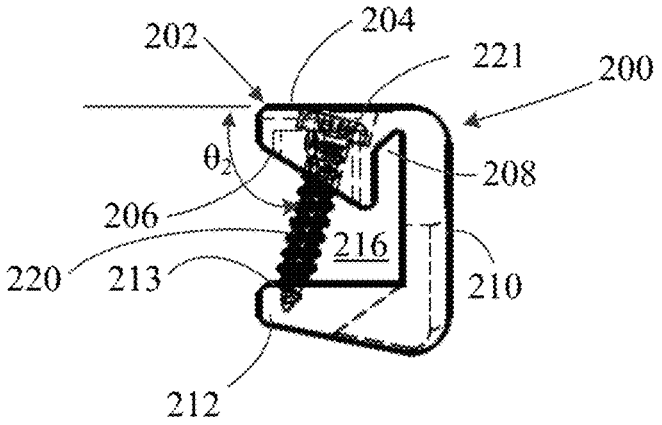
FIG. 8B is a cross-sectional view of the retainer device of FIG. 8A.
Figure 8A:
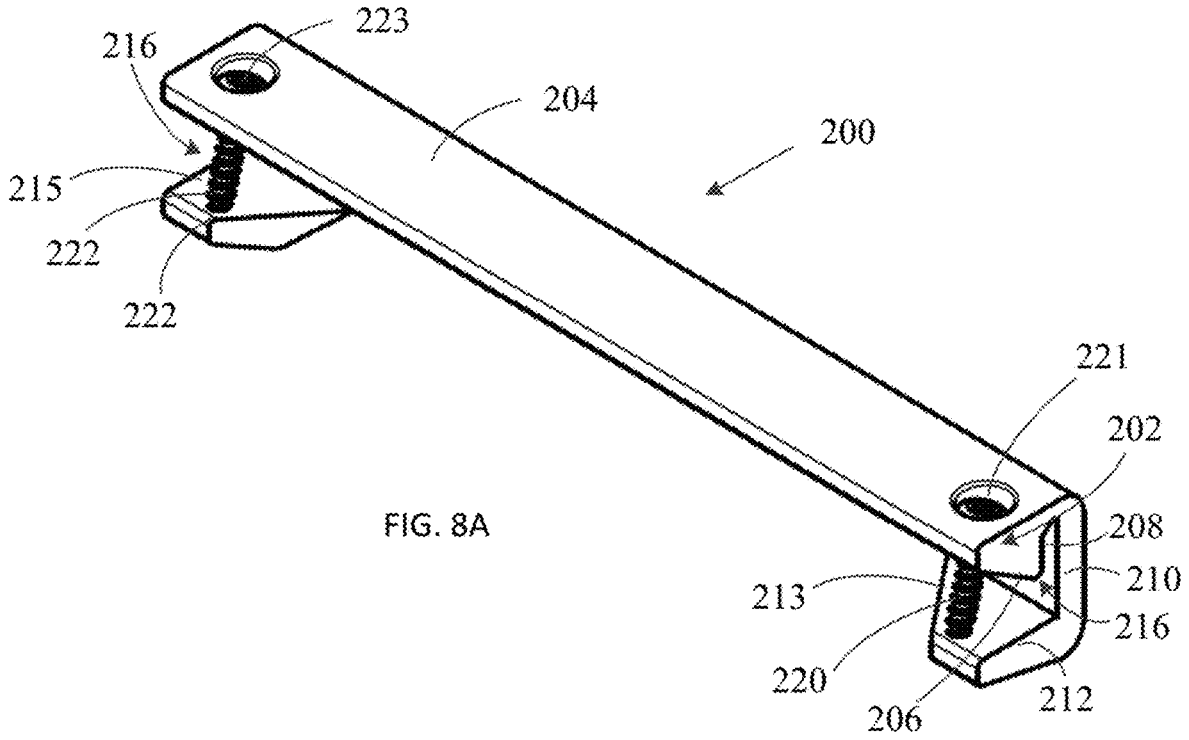
FIG. 8A is a perspective view of the retainer device of FIG. 7 including the installation screws used to interconnect the retainer device to the totes.

In FIGS. 8A and 8B, the tote retainer device 200 is shown with screws 220 and 222 inserted through holes 221 and 223, respectively, which are used to secure the retainer device 200 to the totes being interconnected to form the array. It should be noted that screws 220 and 222 would not be inserted until the portions of the totes being retained are inserted into region 216 of the tote retainer device 200. However, the screws are shown in this view to more clearly depict their installation and orientation. Holes 221 and 223 are located in top surface 204 of elongated body member 202 and exit through bottom surface 206. Holes 221 and 223 may be disposed at an angle, $\Theta_2$, relative to surface 221 to make the screw head easier to access with a screw driver when the retainer device 200 is installed on the totes to be interconnected and the screws are installed. In the embodiment shown angle, $\Theta_2$, is approximately 75 degrees but this angle may be varied depending on the particular application. It can be seen that screws 220 and 220 when inserted fully into holes 221 and 223 impact surfaces 213 and 215 of leg members 212 and 214, respectively.

FIG. 9 shows a cross-sectional view of the retainer device 200 interconnecting the stacked two tote configuration as shown in FIG. 6. The view of FIG. 9 is taken from the rear of totes 150 and 152 showing the left side top edge 154 of tote 150 engaged with bottom edge flange 166 of tote 152. Bottom edge flange 166 is shown to include a top surface 180 which is disposed at an angle complementary to angle $\Theta_1$ of bottom surface 206 of elongated body member 202 of retainer device 200. Bottom edge flange 166 also includes a bottom surface 182 which is seated on rail 184 of top edge 154 of tote 150. Thus, when bottom edge flange 166 of tote 152 is seated on rail 184 of top edge 154 of tote 150 and the retainer device 200 is installed, surface 180 of the bottom edge flange 166 is aligned with and conforms to bottom surface 206 of elongated body member 202.

During installation, retainer device 200 is forced over top edge 154 such that lip 155 is inserted into channel 208 and the bottom edge flange 166 and rail 184 on which it is seated are positioned in region 216 of retainer device 200. In the installed position it can be seen that top surface 213 of foot member 212 is spaced from the bottom surface of rail 184 and top surface 180 of bottom edge flange 166 is engaged with surface 206 of elongated body member 202. The spacing between top surface 213 of foot member 212 from the bottom surface of rail 184 provides some level of "play" to place the retainer over the bottom edge flange 166 of tote 152 and the top edge 154 of tote 150 while being able to guide lip 155 into channel 208. Once the retainer device 200 is in position on the totes, screw 220 may be placed through hole 221 the elongated body member 202 of retainer device 200 and driven through bottom edge flange 166 and rail 184 and into leg member 212 of retainer device 200.

With another retainer device installed on the opposite side of totes 150 and 152, the tote array will be ready for use. If at a later time, the individual totes are needed for another purpose, the screws may be removed from retainer device 200 and the device may be easily removed from top edge 154 of tote 150. The retainer device on top edge 158 (FIG. 6) may also be removed and then totes 150 and 152 may be separated without any damage, other than the screw holes in the bottom edge flange 166 in tote 152 and rail 184 of tote 150. The totes may be reused as stand-alone totes or as part of another tote array, in which case the screw holes may simply be reused as well.

While the foregoing description of the invention enables one of ordinary skill to make and use what is considered presently to be the best mode thereof, those of ordinary skill will understand and appreciate the existence of variations, combinations, and equivalents of the specific embodiments and examples herein. The above-described embodiments of the present invention are intended to be examples only. Alterations, modifications and variations may be effected to the particular embodiments by those of skill in the art without departing from the scope of the invention, which is defined solely by the claims appended hereto. The invention is therefore not limited by the above described embodiments and examples.

Having described the invention, and a preferred embodiment thereof, what is claimed as new and secured by Letters Patent is:

1. A retainer device for removably connecting a first tote to a second tote in a stacked arrangement, the first tote including a rail disposed along a top edge of the first tote and a lip disposed adjacent to the rail, the second tote including a flange disposed along a bottom edge of the second tote, the flange of the second tote being seated on the rail of the first tote when the second tote is stacked on the first tote; the retainer device comprising:

an elongated body member including a top surface, a bottom surface, and a channel disposed in the bottom surface and extending along a length of the elongated body member;

a leg member affixed to the elongated body member at a first angle with respect to the top surface of the elongated body member and extending at least partially along the length of the elongated body member;

at least one foot member having a top surface; the at least one foot member affixed to the leg member at a second angle such that the top surface of at least one foot member faces the bottom surface of the elongated body member to define a region there between;

wherein the channel is configured to receive and engage with the lip of the first tote and the region defined between the top surface of at least one foot member and the bottom surface of the elongated body member is configured to receive and engage with the rail of the first tote and the flange of the second tote when the second tote is stacked on the first tote and;

wherein the top surface of the elongated body member includes at least one hole which extends at an angle through the bottom surface of the elongated body member, the at least one hole being aligned with the at least one first foot member.

2. The retainer device of claim 1 wherein the first and second angles are substantially 90 degrees.

3. The retainer device of claim 1 wherein the elongated body member, the leg member, and the at least one foot member are integrally formed.

4. The retainer device of claim 1 wherein the leg member extends along the entire length of the elongated body member.

5. The retainer device of claim 1 wherein the channel is disposed between the bottom surface of the elongated body member and the leg member.

6. The retainer device of claim 1 wherein the at least one foot member includes a first foot member located proximate a first end of the elongated body member and a second foot member located proximate a second end of the elongated body member, and each foot member has a top surface which faces the bottom surface of the elongated body member.

7. The retainer device of claim 6 wherein the top surface of the elongated body member includes two holes which extend at an angle through the bottom surface, one hole being aligned with the first foot member and the other hole being aligned with the second foot member.

8. The retainer device of claim 7 wherein the angle of the two holes is approximately 75 degrees with respect to the top surface of the elongated body member.

9. The retainer device of claim 7 wherein when the rail of the first tote and the flange of the second tote when the second tote is stacked on the first tote are positioned in the region, the holes are configured to receive screws which are inserted through the rail of the first tote and the flange of the second tote and into the respective top surface of the first and second foot members to secure the retainer device to the first and second totes.

10. The retainer device of claim 7 wherein bottom surface of the elongated body member is disposed at an angle relative to the top surface of the elongated body member and wherein the angle is complementary to an angle of a top surface of the flange of the second tote.

11. The retainer device of claim 10 wherein the bottom surface of the elongated body member is disposed at an angle of substantially 30 degrees.

* * * * *